US005118466A

United States Patent [19]

Raymond et al.

[11] Patent Number: 5,118,466

[45] Date of Patent: Jun. 2, 1992

[54] NUCLEAR REACTOR COOLANT PUMP WITH INTERNAL SELF-COOLING ARRANGEMENT

[75] Inventors: James R. Raymond, Allegheny Township, Westmoreland County; Clarence I. Thomson, III, Murrysville, both of Pa.

[73] Assignee: Westinghouse Electric Corp., Pittsburgh, Pa.

[21] Appl. No.: 491,927

[22] Filed: Mar. 12, 1990

[51] Int. Cl.[5] ..... G21C 19/28

[52] U.S. Cl. ..... 376/404; 376/361; 417/370

[58] Field of Search ..... 376/404, 361, 402, 405; 417/370, 369, 368

[56] References Cited

U.S. PATENT DOCUMENTS

| | | | |
|---|---|---|---|
| 1,911,128 | 5/1933 | Apple | 417/371 |
| 1,974,678 | 9/1934 | Lafont | 103/87 |
| 2,606,501 | 8/1952 | Dreibelbis | 103/87 |
| 2,763,214 | 9/1956 | White | 103/87 |
| 3,115,839 | 12/1963 | Pollak et al. | 103/87 |
| 3,644,067 | 2/1972 | Yowell | 417/370 |
| 3,790,309 | 2/1974 | Volz | 417/368 |
| 3,891,355 | 6/1975 | Hecht et al. | 417/371 |
| 4,086,034 | 4/1978 | Hokky | 417/369 |
| 4,349,322 | 9/1982 | Stahle | 417/370 |
| 4,538,968 | 9/1985 | Kusakawa | 417/368 |
| 4,644,202 | 2/1987 | Kroy et al. | 417/370 |
| 4,699,573 | 10/1987 | Petrie et al. | 417/370 |
| 5,017,102 | 5/1991 | Shimaguchi et al. | 376/404 |

FOREIGN PATENT DOCUMENTS

| | | |
|---|---|---|
| 0163126 | 12/1985 | European Pat. Off. . |
| 854165 | 11/1960 | United Kingdom . |

*Primary Examiner*—Brooks H. Hunt
*Assistant Examiner*—Frederick H. Voss

[57] ABSTRACT

A nuclear reactor coolant pump has a casing defining an inlet nozzle for receiving a reactor coolant fluid, an outlet nozzle for discharging the fluid, and a passage interconnecting the inlet and outlet nozzles through which the fluid can flow in a main stream from the inlet nozzle to outlet nozzle. The pump also has a central rotor with one end disposed adjacent the annular passage of the casing and opposite bearings rotatably mounting the rotor to the casing. A motor is disposed about the rotor and between the bearings and is operable for rotatably driving the central rotor. An impeller is mounted to the one end of the rotor in communication with the annular passage and the flow of fluid therethrough. The impeller rotates with the rotor to create a lower pressure at the inlet nozzle than at the outlet nozzle for drawing the reactor coolant fluid into the casing through the inlet nozzle and discharging the fluid from the casing through the outlet nozzle. A self-cooling arrangement provided in the pump defines a fluid flow loop in communication with the annular passage and in heat transfer relationship with the bearings and motor. The self-cooling arrangement is operable for diverting only a fraction of the fluid from and back to the main stream through the annular passage to cool the bearings and motor. Foreign particle deflectors are provided to minimize passage of particles into the fluid flow loop.

12 Claims, 4 Drawing Sheets

NUCLEAR REACTOR COOLANT PUMP WITH INTERNAL SELF-COOLING ARRANGEMENT

BACKGROUND OF THE INVENTION

1. Field of the Invention

The present invention relates generally to nuclear reactor coolant system pumps and, more particularly, is concerned with an improved reactor coolant pump having an internal self-cooling arrangement.

2. Description of the Prior Art

In pressurized water nuclear power plants, a reactor coolant system is used to transport heat from the reactor core to steam generators for the production of steam. The steam is then used to drive a turbine generator. The reactor coolant system includes a plurality of separate cooling loops, each connected to the reactor core and containing a steam generator and reactor coolant pumps.

In one version of the reactor coolant system used in a nuclear power plant, the reactor coolant pumps are high inertia pumps hermetically sealed and mounted to the one steam generator in the respective coolant loop. Each pump has an outer casing, a central axially extending rotor rotatably mounted at its opposite ends by upper and lower bearings, and a canned motor located about the pump rotor between the upper and lower bearings. The motor includes a rotor section mounted for rotation on the pump rotor and a stator stationarily mounted to the casing about the rotor section. An impeller mounted at one end of the pump rotor rotates therewith and draws reactor coolant water axially through a central inlet nozzle in the pump casing and discharges the water tangentially through an outlet nozzle in the pump casing.

The temperature of the reactor coolant water is typically in the range of from approximately 500° to 600° F. which is too hot to also use to cool the motor and bearings of the pump. Thus, a heat removal arrangement separate from, and which does not employ, the reactor coolant water has been utilized in the prior art. One heat removal arrangement includes an annular hollow jacket surrounding the motor, a set of coils contained in the jacket and surrounding the motor, and other sets of coils located adjacent the upper and lower bearings. The multiple sets of coils are connected in flow communication so as to define a closed path for circulation of an internal coolant fluid therein for cooling the bearings and motor.

The annular jacket of the heat removal arrangement has an inlet and outlet connected in flow communication with an external source of a secondary coolant fluid which can then flow through the jacket over the set of coils contained therein. The secondary coolant fluid is typically at a temperature much lower than the temperature of the internal coolant fluid circulating about the closed path such that the heat carried by the internal coolant fluid gained from cooling the motor and bearings is readily transferred to the secondary coolant fluid through the one set of coils in the jacket.

Use of the above-described heat removal arrangement of the prior art is necessary in reactor cooling systems where the temperature of the reactor coolant water is too high to also be useful in cooling the pump motor and bearings. A drawback of this prior art heat removal arrangement, however, is that it does increase the complexity of the pump.

SUMMARY OF THE INVENTION

The present invention provides an improved reactor coolant pump having an internal self-cooling arrangement designed to avoid the aforementioned drawback. The self-cooling arrangement of the present invention employs reactor coolant water from the main flowstream to cool the pump motor and bearings. The reactor coolant water from the main flowstream, and thus the self-cooling arrangement of the invention, can be used in those situations where the temperature of the reactor coolant water entering the pump is below approximately 200° F. Reactor coolant water at that temperature circulated by the self-cooling arrangement of the improved pump can readily remove motor heat generated by electrical losses and bearing heat generated by friction, eliminating the need for use of an external secondary coolant fluid and a separate internal closed path coolant fluid.

Accordingly, the present invention is directed to a pump for pumping a fluid. The pump comprises: (a) a casing defining an inlet for receiving a fluid, an outlet for discharging the fluid, and a passage interconnecting the inlet and the outlet through which the fluid can flow in a main stream from the inlet to the outlet; (b) a central rotatable rotor having an end disposed adjacent the annular passage of the casing; (c) at least one bearing rotatably mounting the rotor adjacent to the end thereof to the casing; (d) a motor disposed about the rotor and adjacent the bearing and being operable for rotatably driving the central rotor; (e) means mounted to the end of the rotor in communication with the annular passage and the flow of fluid therethrough and being rotatable with the rotor for creating a lower pressure at the inlet of the casing than at the outlet thereof for drawing fluid into the casing through the inlet thereof and discharging fluid from the casing through the outlet thereof after flow of the fluid in the main stream through the annular passage; and (f) a self-cooling arrangement defining a fluid flow loop in flow communication with the annular passage and in heat transfer relationship with the bearing and motor and being operable for diverting only a fraction of the fluid from and back to the main stream through the annular passage to cool the bearings and motor.

More particularly, the fluid flow loop is composed of outer and inner annular loop portions. The outer loop portion extends generally coaxial with, but is located farther radially outwardly from, the central rotor than is the inner loop portion. The fluid flow loop also includes a plurality of entry and exit ports which open respectively into and from the outer and inner loop portions. The entry and exit ports are defined in flow communication with the annular passage. Particularly, the entry ports are located downstream of the exit ports and thus at points of greater pressure in the main stream of the fluid through the annular passage.

Further, the self-cooling arrangement includes foreign particle deflectors provided with respect to the fluid flow loop so as to minimize passage of particles into the fluid flow loop and to collect those particles which do enter the loop at a desired location along the loop.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
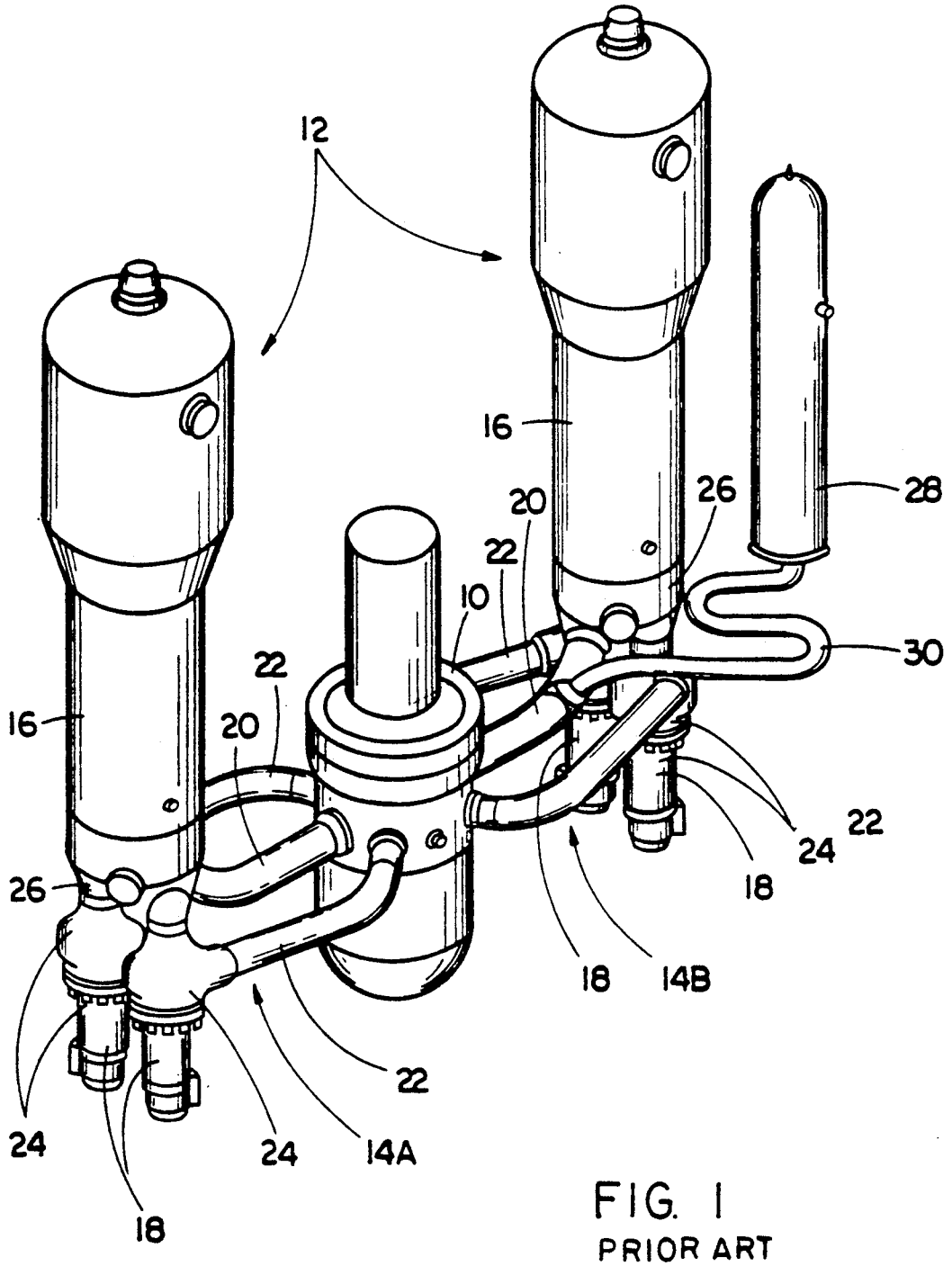
FIG. 1 PRIOR ART
FIG. 1 is a perspective view of a prior art nuclear reactor core and coolant system connected thereto.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

In General

Referring now to the drawings, and particularly to FIG. 1, there is shown a prior art nuclear reactor core vessel 10 and coolant system 12 connected thereto. The reactor coolant system 12 includes two coolant loops, generally indicated by the numerals 14A and 14B. Each of the coolant loops 14A, 14B includes a single steam generator 16, a pair of high inertia canned motor pumps 18, a single hot leg pipe 20, and a pair of cold leg pipes 22.

The pair of prior art pumps 18 in each coolant loop 14A, 14B are hermetically sealed and mounted in inverted positions to the one steam generator 16 in the respective coolant loop. Each pump 18 has a casing 24 which is attached, such as by welding, directly to the bottom of a channel head 26 of the steam generator 16 so as to effectively combine the two components into a single structure.

The hot leg pipes 20 extend between and interconnect the reactor vessel 10 and the respective steam generators 16 for routing high temperature reactor coolant from the vessel 10 to the steam generators 16. The cold leg pipes 22 extend between and interconnect the pumps 18 and the reactor vessel 10 for routing lower temperature reactor coolant from the steam generators 16 via the pumps 18 back to the reactor vessel 10. Further, a pressurizer tank 28 is connected by a surge line 30 to one of the hot leg pipes 20.

Prior Art Coolant Pump With External Heat Removal Arrangement

Figure 2:
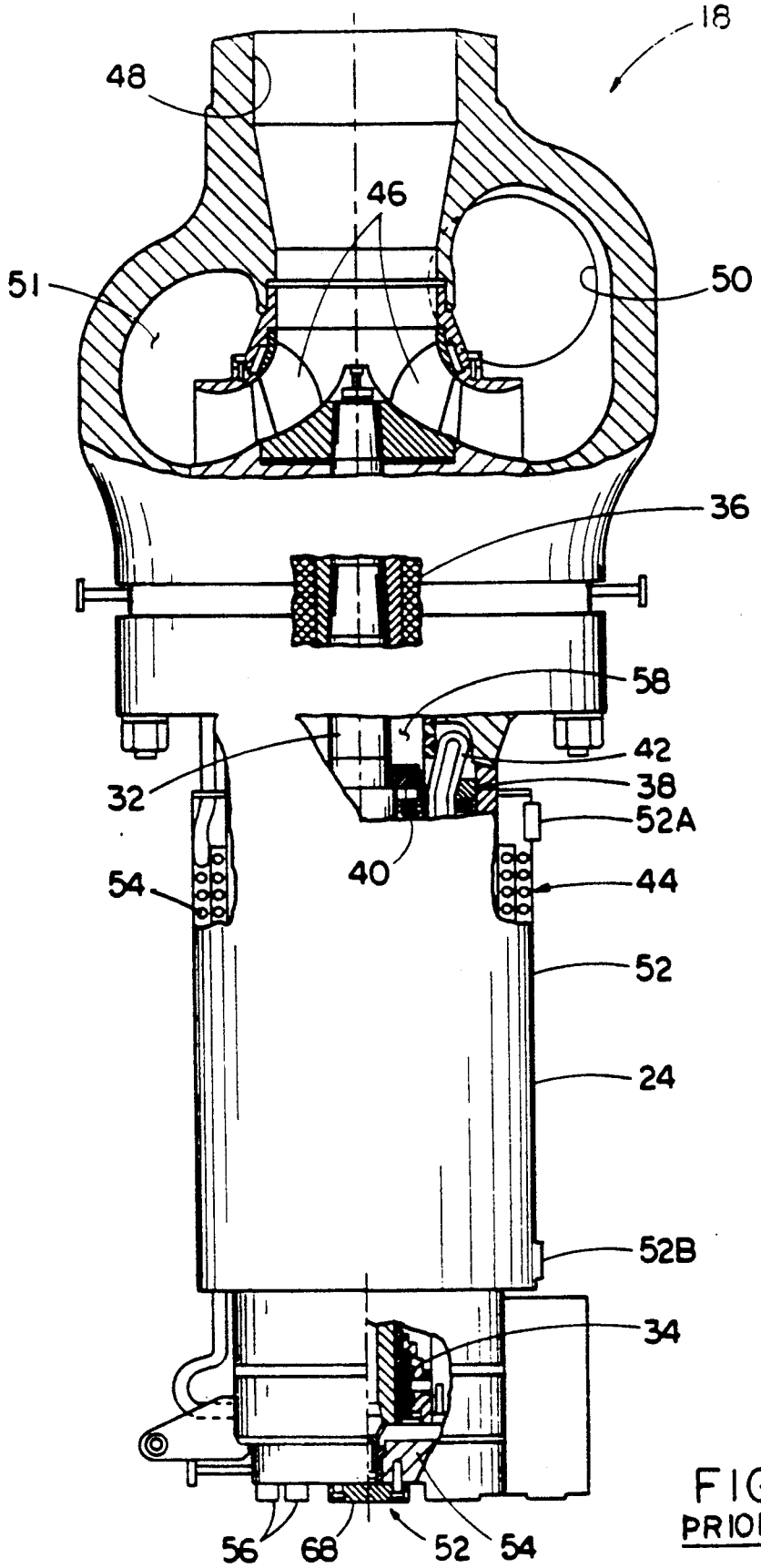
FIG. 2 PRIOR ART
FIG. 2 is an enlarged elevational view, with portions broken away and sectioned, of one of the prior art reactor coolant pumps of the coolant system of FIG. 1.

Referring to FIG. 2, there is illustrated in greater detail one of the prior art reactor coolant pumps 18. In addition to its casing 24, the pump 18 has a central rotor 32 extending axially through the casing 24 and rotatably mounted to the casing adjacent a lower end 32A by a pivot pad bearing 34 and adjacent an upper end 32B by a thrust bearing 36. A canned motor 38 is located about the pump rotor 32 between the opposite lower and upper bearings 34, 36. The motor 38 includes a rotor section 40 mounted to the pump rotor 32 for rotation therewith and a stator section 42 mounted stationarily to the casing 24 about the rotor section 40.

For removing heat to cool the lower and upper bearings 34, 36 and the motor 38, the pump 18 also includes a heat removal arrangement 44 which is separate from the reactor coolant water circulated through the coolant loop 14A, 14B. Further, the pump 18 has an impeller 46 mounted at the upper end 32B of the rotor 32 which rotates therewith. One end 24A, such as the upper end, of the pump casing 24 has a central inlet nozzle 48, a peripheral outlet nozzle 50 and an annular passage 51 which interconnects the inlet and outlet nozzles 48, 50. The pump impeller 46 is disposed across the annular passage 51 and in flow communication with reactor coolant water flowing in a main stream therethrough. Operation of the motor 38 causes rotation of the rotor 32 and the impeller 46 therewith. Rotation of the impeller 46 draws water axially through the central inlet nozzle 48 from the steam generator 16 and discharges the water tangentially through the outlet nozzle 50 to the respective one of the cold leg pipes 22, after flowing through the annular passage 51. In such manner, operation of the pumps 18 creates lower pressure at their inlet nozzles 48 which sucks or draws water from the reactor vessel 10 via the respective hot leg pipes 20 to and through the steam generators 16 and positive pressure at their outlet nozzles 50 which pumps water through the cold leg pipes 22 back to and through the reactor vessel 10.

The heat removal arrangement 44 includes an annular hollow jacket 52 surrounding the motor 38, a set of coils 54 contained in the jacket 52 and surrounding the motor 38, and other respective sets of coils (not shown) located adjacent the lower and upper bearings 34, 36. The multiple sets of coils are connected in flow communication so as to define a closed path for circulation of an internal coolant fluid therein for cooling the bearings 34, 36 and motor 38. The annular hollow jacket 52 of the heat removal arrangement 44 has an inlet 52A and an outlet 52B connected in flow communication with an external source (not shown) of a secondary coolant fluid which can then flow through the jacket 52 over the set of coils 54 contained therein. The secondary coolant fluid is typically at a temperature much lower than the temperature of the internal coolant fluid circulating about the closed path such that the heat carried by the internal coolant fluid gained from cooling the bearings 34, 36 and motor 38 is readily transferred to the secondary coolant fluid through the set of coils 54 in the jacket 52.

Improved Coolant Pump With Self-Cooling Arrangement

Figure 3:
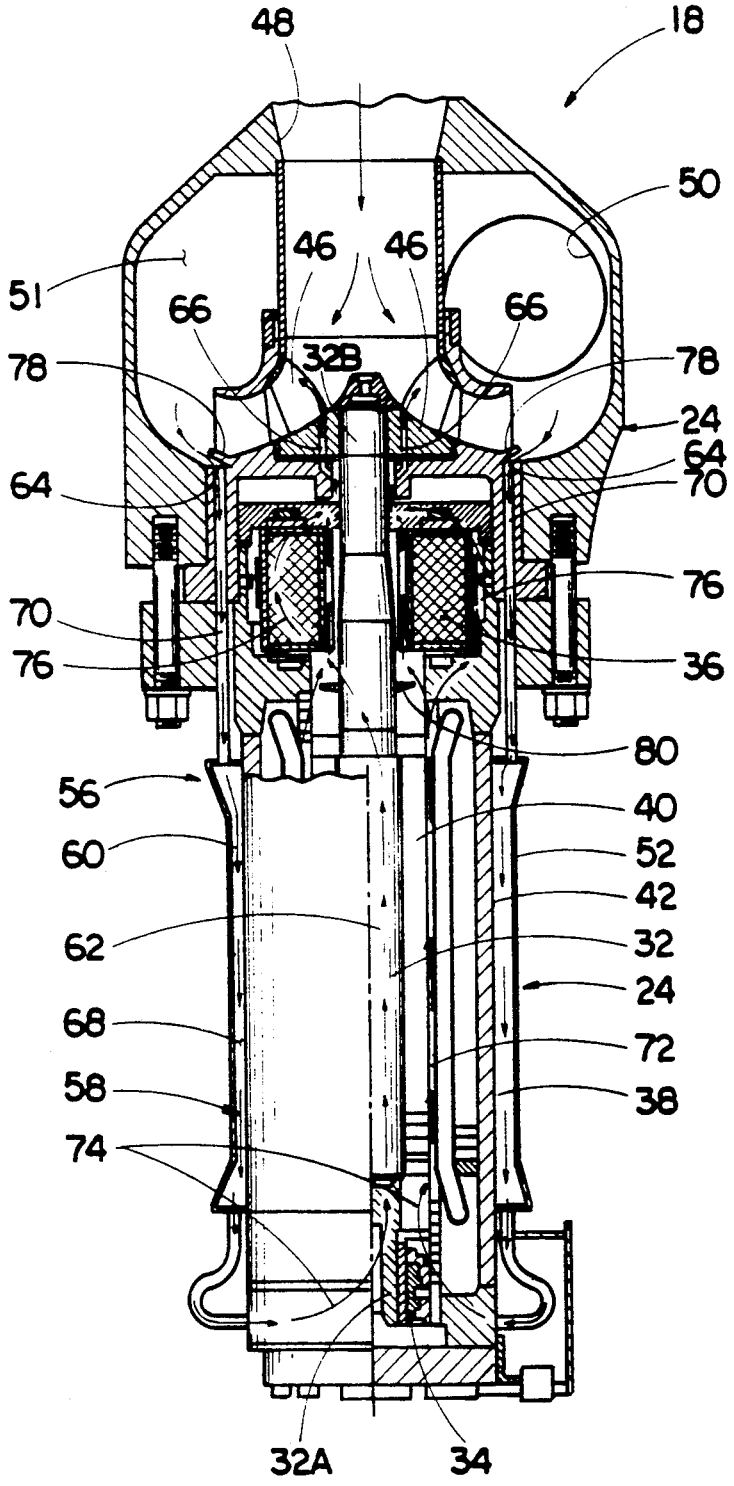
FIG. 3 is an axial sectional view of an improved reactor coolant pump which can be used in place of the prior art pump of FIG. 2 in the coolant system of FIG. 1.
Figure 4:
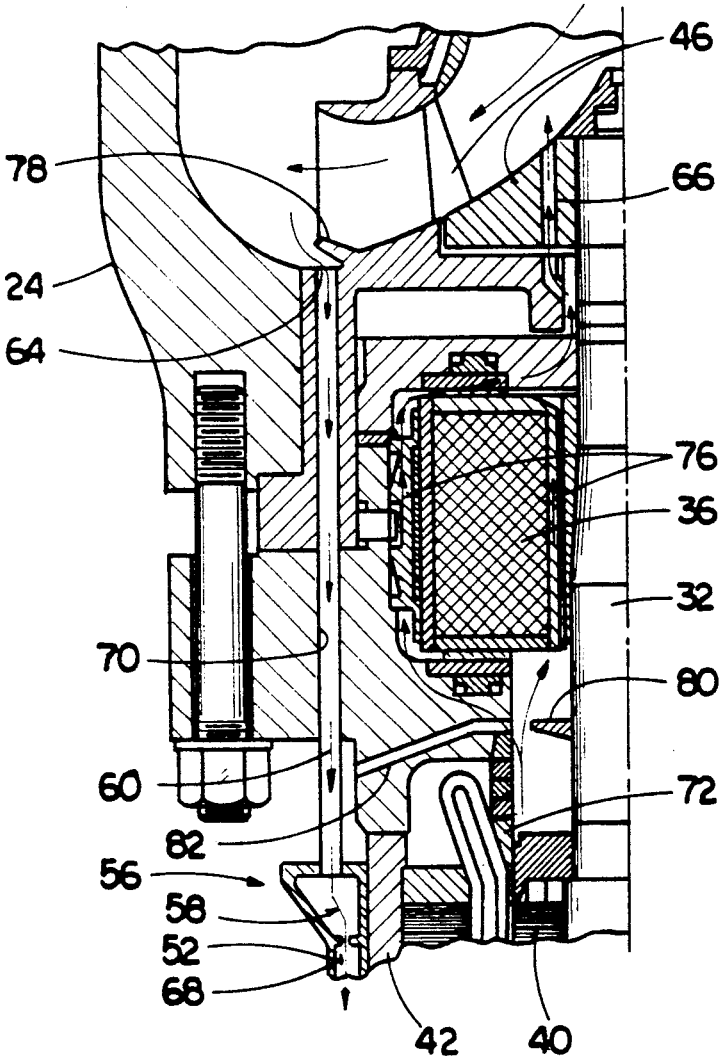
FIG. 4 is an enlarged fragmentary view of the improved pump of FIG. 3.

Turning to FIGS. 3 and 4, there is illustrated an improved version of the pump 18 having a self-cooling arrangement 56 in accordance with the principles of the present invention. The self-cooling arrangement 56 employs some of the reactor coolant water to cool the pump rotor bearings 34, 36 and pump motor 38. Only a fraction, for example one percent, of the reactor coolant water is diverted from the main stream of coolant water flowing through the annular passage 51 by the self-cooling arrangement 56 before return to the main stream. The self-cooling arrangement 56 can be used in reactor applications where the temperature of the reactor coolant water entering the pump 18 is below approximately 200° F. Reactor coolant water at that temperature can readily remove motor heat generated by electrical losses and bearing heat generated by friction, eliminating the need for use of the external secondary coolant fluid and separate internal closed path coolant fluid as in the case of the prior art heat removal arrangement 44.

Referring to FIG. 3, the self-cooling arrangement 56 provided in the pump 18 defines a fluid flow loop 58, with the arrows in FIG. 3 identifying the direction of coolant water flow about the loop 58. The fluid flow loop 58 provides flow of reactor coolant water from the annular passage 51 into a heat transfer relationship with the bearings 34, 36 and the motor 38 before returning the flow back to the annular passage 51. As mentioned above, the self-cooling arrangement 56 is operable for diverting only a fraction, such as approximately one percent, of the reactor coolant water from and back to the main stream through the annular passage 51 to cool the bearings and motor.

The fluid flow loop 58 of the self-cooling arrangement 56 is composed of outer and inner annular loop portions 60, 62. The outer loop portion 60 extends generally coaxial with, but is located farther radially outwardly from, the central rotor 32 than is the inner loop portion 62. The annular configurations of the outer and inner loop portions 60, 62 promote uniform flow of the coolant water about the loop 58 and past the bearings 34, 36. The coolant water flows from the lower end toward the upper end of the pump 18 along the outer annular loop portion 60 and in the opposite direction along the inner annular loop portion 62.

The fluid flow loop 58 also includes a plurality of entry and exit ports 64, 66 which open respectively into and from the outer and inner loop portions 60, 62. The entry and exit ports 64, 66 are defined in flow communication with the annular passage 51. Particularly, the entry ports 64 are defined in the casing 24, whereas the exit ports 66 are defined through the rotor 32. Also, the entry ports 64 are located downstream of the exit ports 66. Thus, the entry ports 64 are defined at the high pressure discharge side of the pump 18 or at points of greater pressure in the main stream of the coolant water through the annular passage 51, whereas the exit ports 66 are defined at the low pressure suction side of the pump 18 or at points of lesser pressure in the main stream of water flow through the passage 51.

The outer portion 60 of the fluid flow loop 58 is formed by an outer annulus 68 which surrounds the exterior of the motor 38 and a plurality of channels 70 which extend between the outer annulus 68 and the entry ports 64. More particularly, the casing 24 has the cylindrical hollow jacket 52 which surrounds and is spaced outwardly from the exterior of the stator section 42 of the motor 38 to define the outer annulus 68. The inner portion 62 of the fluid flow loop 58 is formed by an inner annulus 72 which surrounds the exterior of the central rotor 32 and motor rotor section 40 and is defined by the clearance between rotary rotor and stationary stator sections 40, 42 of the motor 38. The inner loop portion 62 also includes lower and upper pathways 74, 76 defined along and past the lower and upper bearings 34, 36. The lower pathways 74 interconnect in flow communication the lower end of the inner annulus 72 with the exit ports 66, whereas the upper pathways 76 interconnected in flow communication the upper end of the inner annulus 72 with the upper end of the outer annulus 68. The outer and inner loop portions 60, 62 thus generally extend coaxially with the central rotor 32.

Further, the self-cooling arrangement 56 includes foreign particle deflectors provided with respect to the fluid flow loop so as to minimize passage of particles into the fluid flow loop 58 and to collect those particles which do pass into the loop 58 at a desired location along the loop 58. More particularly, one form of the foreign particle deflectors is a plurality of deflector elements 78 mounted to casing 24 adjacent entry ports 64 and projecting into the annular passage 51 upstream of the entry ports 64 for impeding particles entrained in the main stream of fluid flow from leaving the main stream and passing through the entry ports 64 into the outer portion 60 of the fluid flow loop 58. Most particles moving at greater momentum will tend to pass the entry ports 64 or be deflected downstream past the ports 64.

Another form of the foreign particle deflectors is a centrifugal separator element 80 mounted to the rotor 32 upstream of the lower bearing 34 for rotation with the rotor. The separator element 80 extends across the inner loop portion 62 for striking particles still entrained in the flow of fluid in loop 58 and flinging the particles outwardly thereof. An annular deadend cavity 82 is defined in a radial portion of the casing 24 radially spaced outwardly from and surrounding the rotational path of the separator element 80 which is capable of receiving and trapping particles flung therein by the separator element 80 upon rotation of the rotor 32. Such collected particles are thus prevented from entering the lower bearing 34 where they could cause damage.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

We claim:

1. A nuclear reactor coolant pump for pumping reactor coolant fluid in a reactor coolant system, said pump comprising:

(a) a casing having an end defining a central inlet nozzle for receiving a reactor coolant fluid, a peripheral outlet nozzle for discharging the reactor coolant fluid, and an annular passage interconnecting said inlet nozzle and said outlet nozzle through which the reactor coolant fluid can flow in a main stream from said inlet nozzle to said outlet nozzle;

(b) a central rotor extending axially through said casing and having opposite ends, one of said ends being disposed adjacent said annular passage defined by said casing end;

(c) first and second bearings rotatably mounting said rotor adjacent said opposite ends thereof to said casing;

(d) a motor disposed about said rotor and between said first and second bearings, said motor including a rotor section mounted to said central rotor for rotation therewith and a stator section mounted stationarily to said casing and about said rotor section, said motor being operable for rotatably driving said central rotor;

(e) an impeller mounted to said one end of said central rotor in communication with said annular passage and rotatable with said rotor so as to create a lower pressure at said central inlet nozzle than at said peripheral outlet nozzle thereof for drawing reactor coolant fluid axially into said one casing end through said central inlet nozzle thereof and discharging reactor coolant fluid from said one casing end tangentially through said peripheral outlet nozzle thereof after movement in a main flow-stream through said annular passage of said one casing end; and (f) a self-cooling arrangement defining a fluid flow loop in flow communication with said annular passage and in heat transfer relationship with said first and second bearings and said motor and being operable for diverting only a small fraction of the reactor coolant fluid from and back to said main stream through said annular passage to cool said bearings and motor.

2. The pump as recited in claim 1, wherein said fluid flow loop includes outer and inner loop portions, said outer loop portion being located farther radially outwardly from said central rotor than said inner loop portion.

3. The pump as recited in claim 2, wherein:

said inner loop portion includes an inner annulus; and said outer loop portion includes an outer annulus surrounding and spaced radially outwardly from said inner annulus.

4. The pump as recited in claim 3, wherein said inner loop portion further includes lower and upper pathways defined along and past said lower and upper bearings, said upper pathways connecting in flow communication said inner annulus and said annular passage, said lower pathways connecting in flow communication said inner annulus and said outer annulus.

5. The pump as recited in claim 1, wherein said self-cooling arrangement includes a plurality of entry and exit ports to said loop defined in flow communication with said annular passage, said entry ports being located downstream of and at points of greater pressure in the main stream of fluid flow than said exit ports.

6. The pump as recited in claim 5, wherein said exit ports are defined through said impeller.

7. The pump as recited in claim 5, wherein said fluid flow loop includes outer and inner loop portions, said outer loop portion being located farther radially outwardly from said central rotor than said inner loop portion, said outer loop portion being connected at one end to said entry ports and said inner loop portion being connected at one end to said exit ports, said outer and inner loop portions being interconnected at respective other ends in flow communication with one another.

8. The pump as recited in claim 5, wherein said loop includes:

an outer annulus surrounding an exterior of said motor and defined by a portion of said casing surrounding and spaced outwardly from said motor exterior; and a plurality of channels extending between said outer annulus and said entry ports.

9. The pump as recited in claim 8, wherein:

said motor includes a rotor section mounted to said central rotor for rotation therewith and a stator section mounted stationarily to said casing and about said rotor section; and said loop includes an inner annulus defined by an annular clearance between said rotor and stator sections of said motor.

10. The pump as recited in claim 1, wherein said self-cooling arrangement further includes a plurality of deflector elements mounted to said casing adjacent to and upstream of said entry ports for impeding particles entrained in the main stream of fluid flow from passing through said entry ports.

11. The pump as recited in claim 1, wherein said self-cooling arrangement further includes:

a separator element mounted to said rotor for rotation therewith and extending across said flow loop for striking particles entrained in the flow of fluid in said loop and flinging the particles out of said loop; and an annular deadend cavity defined in said casing and surrounding the rotational path of said separator element of receiving and trapping particles flung therein by said rotating separator element.

* * * * *